US006732509B2

(12) United States Patent
Shiga

(10) Patent No.: US 6,732,509 B2
(45) Date of Patent: May 11, 2004

(54) ENGINE ACOUSTICAL SYSTEM

(75) Inventor: Takao Shiga, Iwata (JP)

(73) Assignee: Yamaha Kabushiki Kaisha, Iwata (JP)

( * ) Notice: Subject to any disclaimer, the term of this patent is extended or adjusted under 35 U.S.C. 154(b) by 6 days.

(21) Appl. No.: 10/065,313

(22) Filed: Oct. 2, 2002

(65) Prior Publication Data

US 2003/0066288 A1 Apr. 10, 2003

(30) Foreign Application Priority Data

Oct. 4, 2001 (JP) ..... 2001-308431

(51) Int. Cl.[7] ..... F02B 27/02

(52) U.S. Cl. ..... 60/312; 60/313; 60/314; 60/322; 181/250; 181/276; 181/277; 123/184.53; 123/184.55; 123/184.56; 123/184.57

(58) Field of Search ..... 60/312, 313, 322, 60/323, 324, 316, 314; 181/250, 276, 277, 229; 123/184.53, 184.56, 184.57, 184.55, 184.54, 184.59

(56) References Cited

U.S. PATENT DOCUMENTS 4,539,947 A * 9/1985 Sawada et al. ..... 123/52 M
4,546,733 A * 10/1985 Fukami et al. ..... 123/52 MB
5,060,271 A * 10/1991 Geddes ..... 381/71.5
5,283,398 A * 2/1994 Kotera et al. ..... 181/224
5,493,080 A * 2/1996 Moss ..... 181/232
5,571,239 A * 11/1996 Kameda et al. ..... 123/184.53
6,006,859 A * 12/1999 Hussaini ..... 181/227
6,105,546 A * 8/2000 Fuesser et al. ..... 123/184.57
6,202,409 B1 * 3/2001 Taylor ..... 60/312
6,508,331 B1 * 1/2003 Stuart ..... 181/250
6,510,920 B1 * 1/2003 Durand ..... 181/249

FOREIGN PATENT DOCUMENTS

| | | | |
|---|---|---|---|
| EP | 000840285 A2 * 5/1998 | ..... | 60/312 |
| JP | 404342813 A * 11/1992 | ..... | 60/312 |
| JP | 6-40921 10/1994 | | |
| JP | 8-74690 3/1996 | | |
| JP | 9-144526 6/1997 | | |
| JP | U3074863 11/2000 | | |

* cited by examiner

*Primary Examiner*—Binh Tran
(74) *Attorney, Agent, or Firm*—Ernest A Beutler

(57) ABSTRACT

A number of embodiments of acoustical devices for improving either or both the intake and exhaust sounds emanated from an internal combustion engine. This is achieved by employing acoustical devices which are configured so as to discharge the desired sound waves to the atmosphere rather than by attempting to dampen the undesired sound waves generated in the system.

21 Claims, 16 Drawing Sheets

ENGINE ACOUSTICAL SYSTEM

BACKGROUND OF INVENTION

This invention relates to an acoustical device for an internal combustion engine and more particularly to an improved device for generating the desired sounds from either or both of the engine induction system and the engine exhaust system.

Various devices have been proposed for use in conjunction with internal combustion engines so as to provide the desired sound in either or both of the induction system and the exhaust system. Generally, the desired sound has been achieved by providing acoustical devices that will tune or minimize the frequencies which are not desired so as to retain the desired frequencies. The problem with these systems is that they require multiple devices to tune out multiple frequencies other than the frequency or frequencies desired. Various types of silencing devices have been employed for attempting to cancel out or reduce the objectionable or undesirable frequencies and these include such things as side branch, resonators and Helmholtz resonators.

It is, therefore, a principal object to this invention to provide an improved acoustical device for an engine that will be capable of rather than tuning out undesired frequencies, amplifying the desired frequencies so as to simply the system.

It is a further object to this invention to provide such an acoustical device for either or both of the engine induction and exhaust systems.

SUMMARY OF INVENTION

This invention is adapted to be embodied in an internal combustion engine comprised of an engine body forming at least one combustion chamber. An induction system is provided having an atmospheric communication opening for introducing at least an air charge to the combustion chamber. An exhaust system is also provided for discharging exhaust gasses from the combustion chamber through an atmospheric communicating opening. An acoustical device for amplifying sounds of a predetermined frequency is provided in at least one of the induction and exhaust systems and has an opening facing the atmospheric communicating opening of the system.

DETAILED DESCRIPTION

Figure 1:
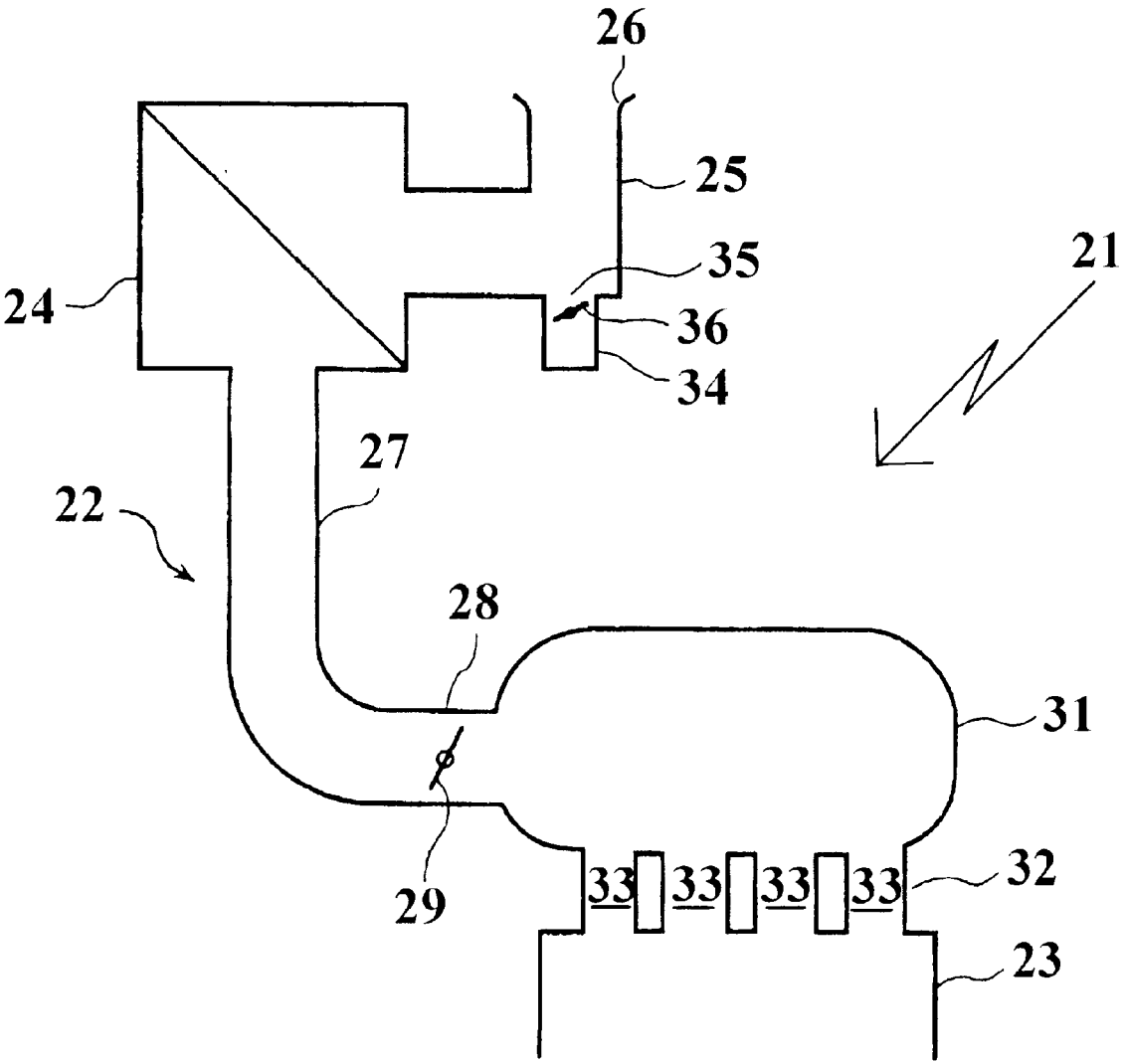
FIG. 1 is a partially schematic, cross-sectional view taken through an internal combustion engine having an acoustical device in its induction system constructed in accordance with a first embodiment of the invention.

Before proceeding with a detailed description of the several embodiments of the invention, it is believed advantageous to describe the theory by which the invention operates and contrast it with the prior art. In conventional systems, as noted in the Background portion of this application, devices such as side branch tubes or Helmholtz resonators have been employed for attenuating certain frequencies which are not desired in the sound of either or both of the induction and exhaust systems. These devices are positioned so that they intersect or extend generally perpendicularly to the flow path through either or both the induction or exhaust systems to interfere with and dampen undesired frequencies. Side branch resonators consist of tubes having a predetermined length and cross sectional area. These devices provide silencing in accordance with the following equation:

$$\text{Side Branch Frequency Effect } f=C/4L\times(2n-1)$$

Where:

C=Sound Velocity

L=Tube Length n=constant (integer)

Thus, it will be seen that the frequency dampened is related to the length and cross sectional area of the side branch tube. However, this is because the side branch tube generates a blocking frequency. In accordance with the invention, the side branch tube is directed so that its opening faces to the atmosphere and hence, this frequency will be amplified rather than dampened. The Helmholtz frequency effect is set forth in the following formula:

$$\text{Helmholtz Frequency Effect } f=[C/2n]\sqrt{[1/V\times Sp/Lp]}$$

Where:

V=Volume of the resonator chamber

C=Sound Velocity n=constant (integer)

Sp=Connecting tube cross sectional area

Lp=Connecting tube length

Thus, by using these Helmholtz resonators as a side branch device extending perpendicularly to the direction of flow, the frequency f is silenced by blocking it. However, in accordance with the invention, the connecting tube has its opening facing the atmosphere and hence, the desired frequency will be amplified rather than damping other frequencies.

The various embodiments will now be described by reference to the drawings and referring first to the embodiment of FIG. 1, the invention is described in conjunction with an internal combustion engine, indicated generally by the reference numeral 21 and more particularly with the induction system 22 thereof.

The engine 21 is comprised of an engine body 23 which, in the illustrated embodiment, is of the four cylinder inline type having four combustion chambers which are served by the induction system 22. Since the construction of the basic engine may be of any desired type, little of the details thereof are believed necessary to permit those skilled in the art to practice the invention.

The induction system 22 has an air cleaner 24 having an angularly disposed inlet pipe 25 with an atmospheric inlet opening 26 for communicating the induction system 22 and specifically the air cleaner 24 with the atmosphere.

The induction system 22 further includes a delivery tube 27 that communicates the downstream side of the air cleaner 24 with a throttle body 28 in which a flow controlling throttle valve 29 is positioned. As is well known, the throttle valve 29 is controlled by the demand of an operator of the engine 21.

The throttle body 28 communicates the atmospheric air with a plenum chamber 31 of an intake manifold, indicated generally by the reference numeral 32. The intake manifold 31 has runner sections 33 each of which communicates with an intake port of the engine body 23. The construction as thus far described may be considered to be conventional.

In accordance with the invention, a side branch tube 34 is provided in the inlet section 25 of the air cleaner 24 and has an opening 35 which faces the atmospheric opening 26 of the inlet device 25. A throttle valve 36 is provided at the mouth of the tube 24 to selectively close or open the communication of the tube 34 with the intake device 25.

When the engine is running at a specified engine speed or range, the valve 36 is opened to permit communication and thus, provide an amplified sound at such desired frequency in the range determined by the aforenoted equation. In addition to this sound amplifying device in the induction system, a device of a similar nature or devices shown in any of FIGS. 8 through 11 may be provided in the exhaust system for providing the same degree of amplification to provide the desired exhaust note.

Figure 2:
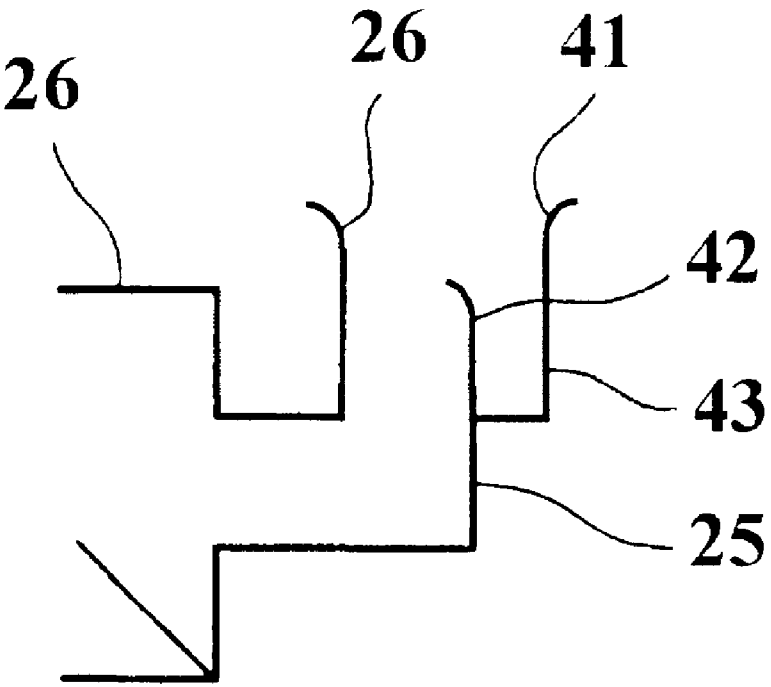
FIG. 2 is a partial cross-sectional view, in part similar to FIG. 1, showing another embodiment of the invention.

FIG. 2 shows another embodiment of the invention which differs only in the positioning of the sound amplifying device in the inlet pipe 25. Therefore, this embodiment is shown only partially in connection with this part of the engine.

The inlet pipe 25 is, in accordance with this embodiment, provided with an enlarged opening 41 at one side of the normal opening 26 thereof to define a further opening 42 of a side branch tube 43 which is formed integrally with the inlet pipe 25 at one side thereof. The opening formed by the walls 41 and 42 faces the atmosphere as with the previously described embodiment and thus functions as aforenoted. If desired, a control valve such as the valve 36 of FIG. 1 may be placed in the opening.

In this embodiment, it is also possible to have the intake portion 41 that forms the chamber 43 transversely moveable so as to increase the effective diameter of the side branch tube and thus provide tuning for amplification of variable frequencies.

Figure 3:
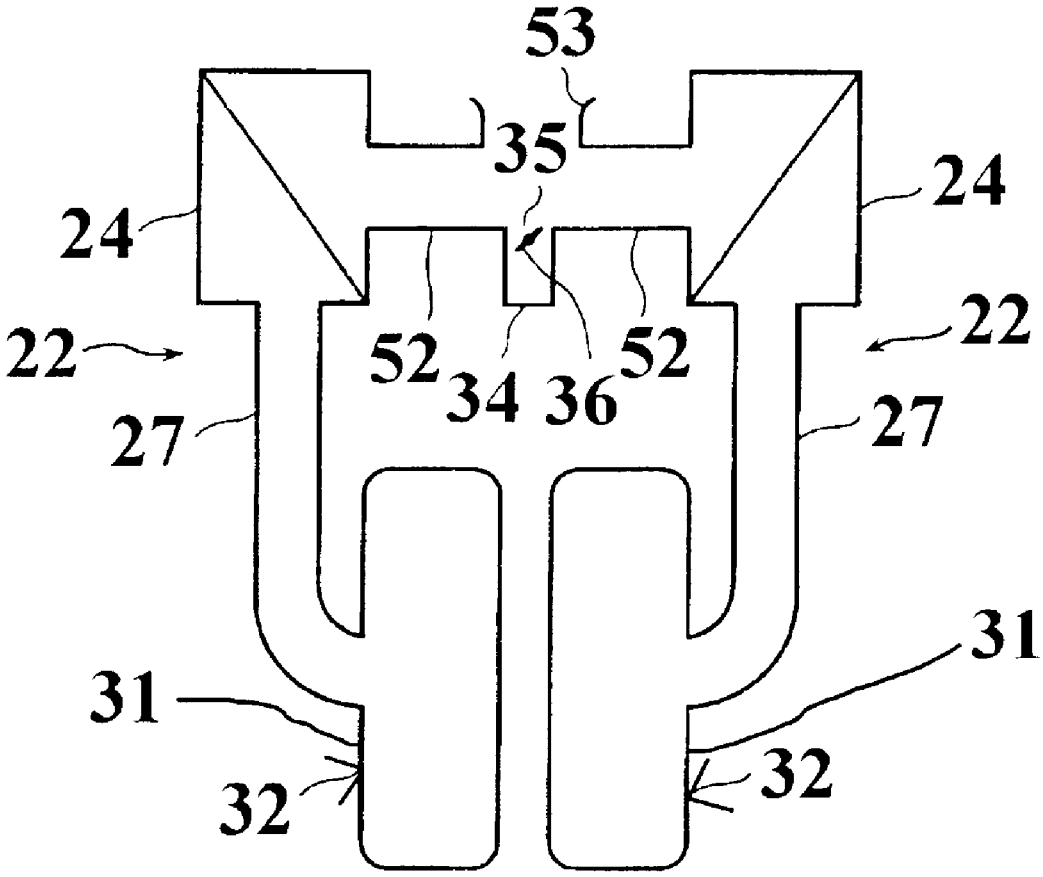
FIG. 3 is a partial schematic view, in part similar to FIGS. 1 and 2, showing a third embodiment of the invention.

FIG. 3 shows an embodiment that can be utilized in conjunction with a V-type engine such as a V-Twin or V-multiple cylinder engine, indicated generally by the reference numeral 51. Each bank of the engine is provided with an induction manifold 32 as previously described including the plenum chamber 31. Each plenum chamber is served by a respective air filter 24 and inlet pipe 27. Throttle valves may be positioned at the inlet pipes or at the main inlet to the system.

In connection with this embodiment, each air filter has a respective inlet section 52 which inlet sections are coextensive with each other and served by a perpendicularly extending atmospheric inlet opening 53. A side branch device 34 having a control valve 36 is positioned so that its opening 35 extends in facing relationship to the inlet opening 53 and thus amplified the sound for both banks of the engine, in accordance with the aforenoted principal.

Figure 4:
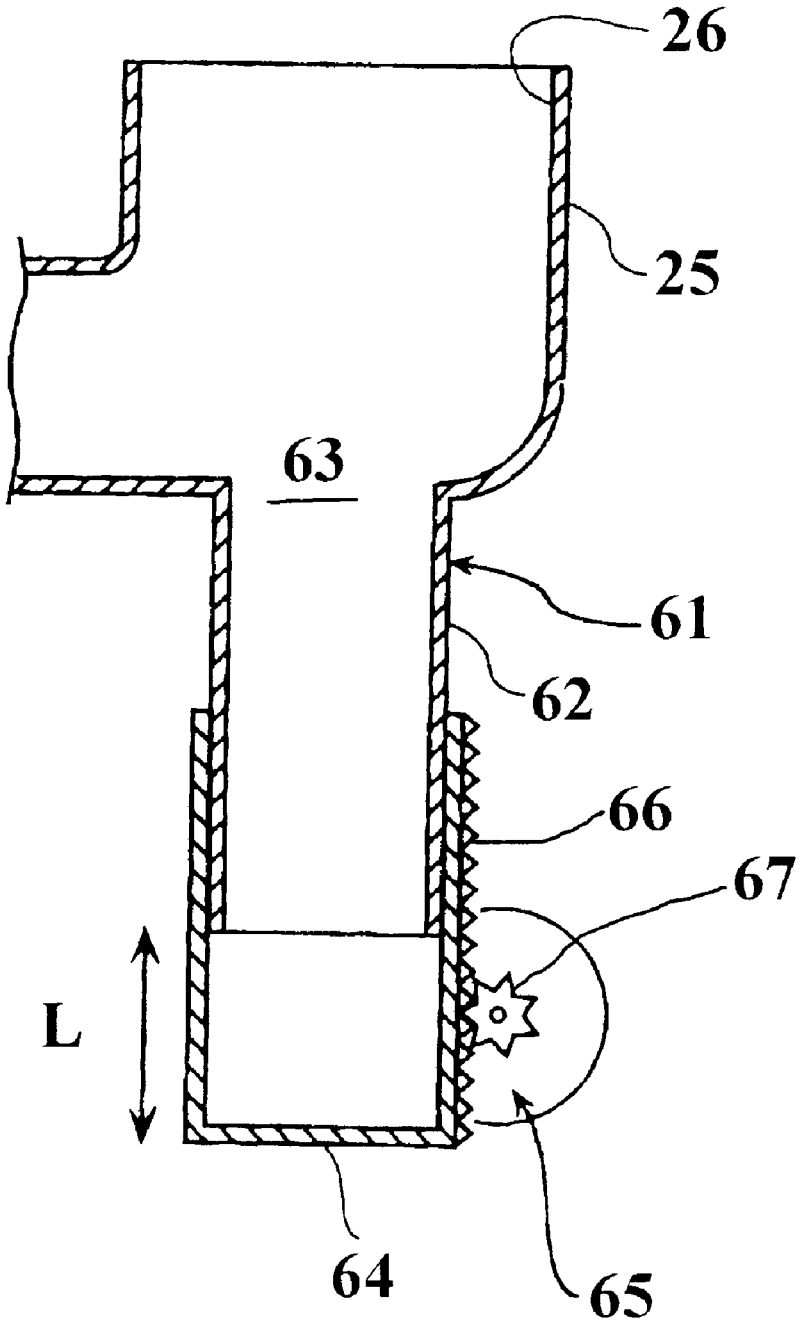
FIG. 4 is a partial schematic cross-sectional view, in part similar to FIGS. 1 through 3, showing a fourth embodiment of the invention.

FIG. 4 shows another embodiment, having a construction generally like the embodiment of FIG. 1 but in this embodiment the side branch device, indicated here by the reference numeral 61, has an effective length that can be varied. This includes a fixed tube portion 62 which is cylindrical and has its opening 63 facing the inlet opening 26 of the inlet device 25.

A closed end cylindrical member 64 is slideably supported on the outer portion of the tube 62 and is actuated by a servo motor 65 through a rack 66 and pinion 67 so as to vary the length indicated by the arrow L and thus, provide tuning for amplifying varying frequencies. The frequency can be changed in accordance with engine speed or any other desired parameter.

Generally, the concept would be that the length or volume is increased as the engine speed decreases and decreased as the engine speed increases. Of course, variations can be made depending upon what effect is desired.

Figure 5:
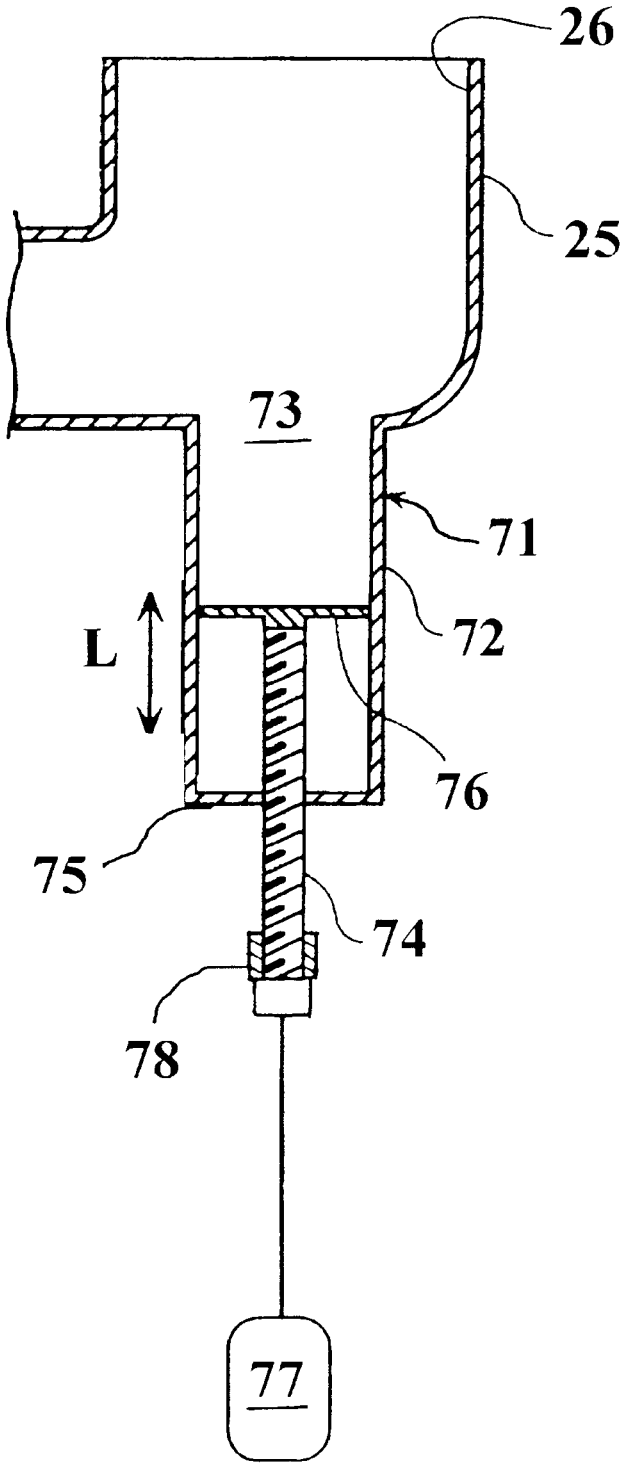
FIG. 5 is a partial cross-sectional view, in part similar to FIG. 4, and shows a fifth embodiment of the invention.

FIG. 5 is another embodiment utilizing a sound amplifying device, indicated generally by the reference numeral 71 which, has its effective length variable. This includes a closed ended tubular section 72 having an opening 73 that faces the opening 26 of the inlet device 25.

A feed screw 74 passes through the end wall 75 of the tube 74 and carries a cylindrical member 76 having a cross sectional area equal to that of the tube. A servo motor 77 operates a drive nut 78 so as to cause the member 76 to be moved in the direction of the arrow L to change the effective length of the device 71. Typically the length will be decreased as the engine speed is increased.

Figure 6:
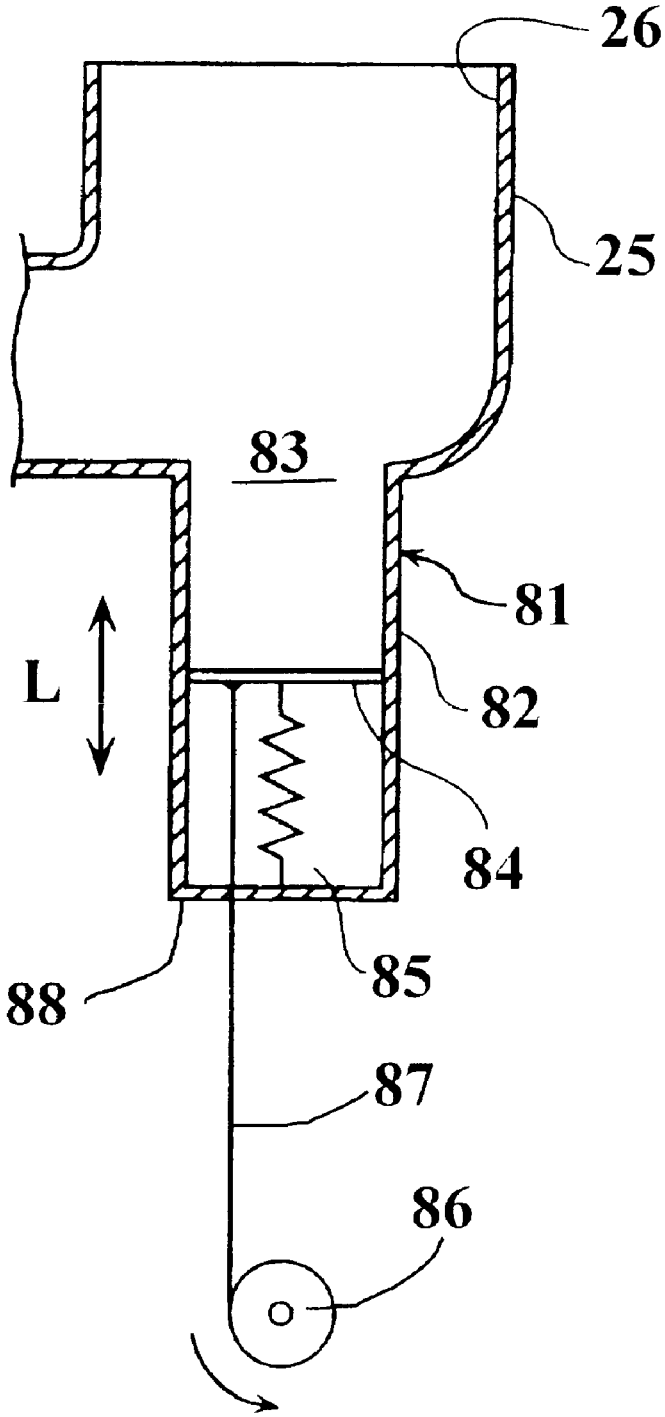
FIG. 6 is a partial cross-sectional view, in part similar to FIGS. 4 and 5, showing a sixth embodiment of the invention.

FIG. 6 is a partial view, in part similar to FIGS. 4 and 5, and shows another embodiment of side branch type amplifying devices, indicated generally by the reference numeral 81. Again, this includes a closed ended tube 82 having an opening 83 that faces the inlet opening 26 of the air inlet device 25 of the engine.

A moveable wall 84 is positioned within the tube 82 and is urged by a spring 84 in a direction to decrease the effective length of the tube 82. A servo motor 86 drives a flexible transmitter 87 that extends through an end wall 88 of the tube 81 so as to position the wall 84 in position along the length L so as to vary the effective length of the device. Again, the position can be varied in response to engine speed so as to provide the desired sound amplification in the induction system.

Figure 7:
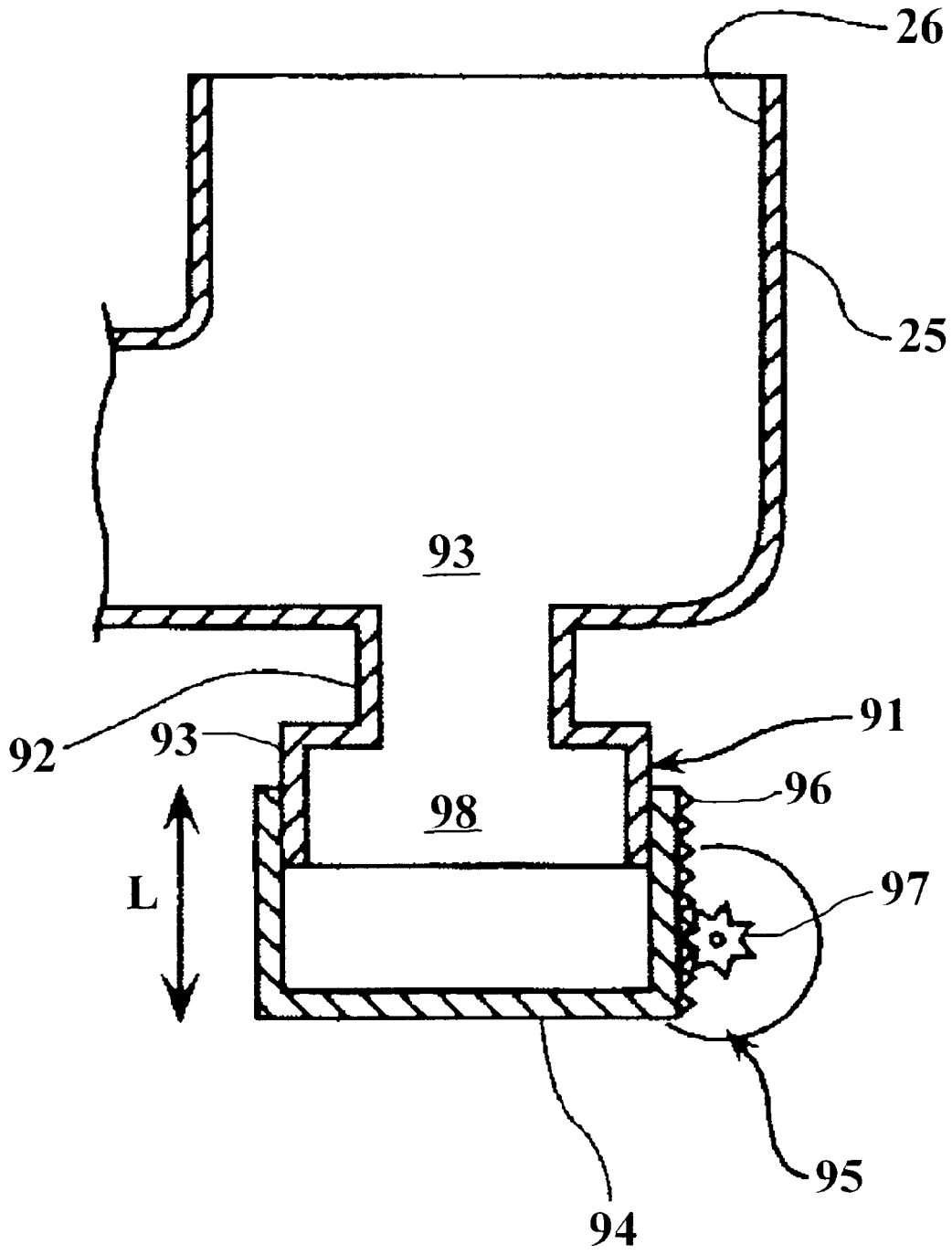
FIG. 7 is a partial cross-sectional view, in part similar to FIGS. 4, 5 and 6 showing a seventh embodiment of the invention.

All of the embodiments as thus far described utilize side branch type tubes. FIG. 7 is a partial view in part similar to FIGS. 2 and 4 through 6, and shows an adjustable Helmholtz device, indicated generally by the reference numeral 91. This Helmholtz device includes a tube section 92 having an opening 93 which faces the opening 26 of the inlet pipe 25 and the atmosphere. The tube 92 has an enlarged portion 93 over which a cylindrical member 94 is slideably positioned. A servo motor 95 drives the cylindrical member 94 through a rack 96 and pinion 95 so as to vary the volume of the resonating chamber 98 and thus, change the amplified frequencies in accordance with the aforenoted equation.

It should be understood also that the length of the tube 92 can be adjusted by utilizing mechanisms of the types shown in FIG. 4 except that in this instance the closed end wall 64 will not be provided. That is, both the length of the tube 92 and volume of the chamber 98 may be adjusted to provide a wider range of sound amplifying effects.

Figure 8:
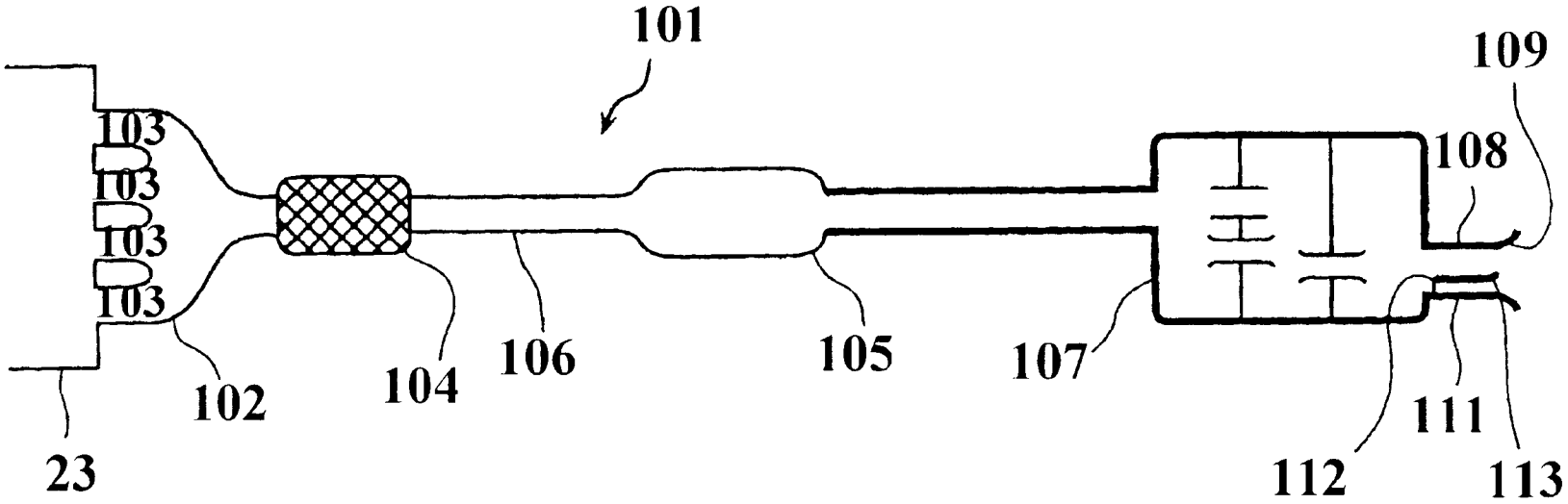
FIG. 8 is a partial schematic view of a portion of an internal combustion engine showing the application of an acoustical device to an exhaust system for the engine.

FIG. 8 is a schematic view of another embodiment of the invention that is utilized with a four cylinder inline engine having an engine body 23 as shown in FIG. 1. However, in this instance, the sound amplifying acoustical system is provided in the engine exhaust system, indicated generally by the reference numeral 101.

The engine exhaust system 101 includes an exhaust manifold 102 having pipe sections 103 each of which communicates with a respective one of the exhaust ports of the engine. The exhaust gases then may flow through a catalytic converter 104 of any known type to a sub-silencer 105 positioned in an exhaust pipe 106.

At the end of the exhaust pipe 106 is provided a main muffler 107 that is provided with any desired type of internal baffling and silencing system. The muffler 107 has an outlet pipe 108 having an outlet opening 109 which communicates with and faces the atmosphere.

Positioned in this outlet pipe 108 is a side branch tube 111 which has a closed end wall 112 and an atmospheric facing opening 113 which is positioned coaxially within the outlet tube 108 and faces its atmospheric opening 109.

Figure 9:
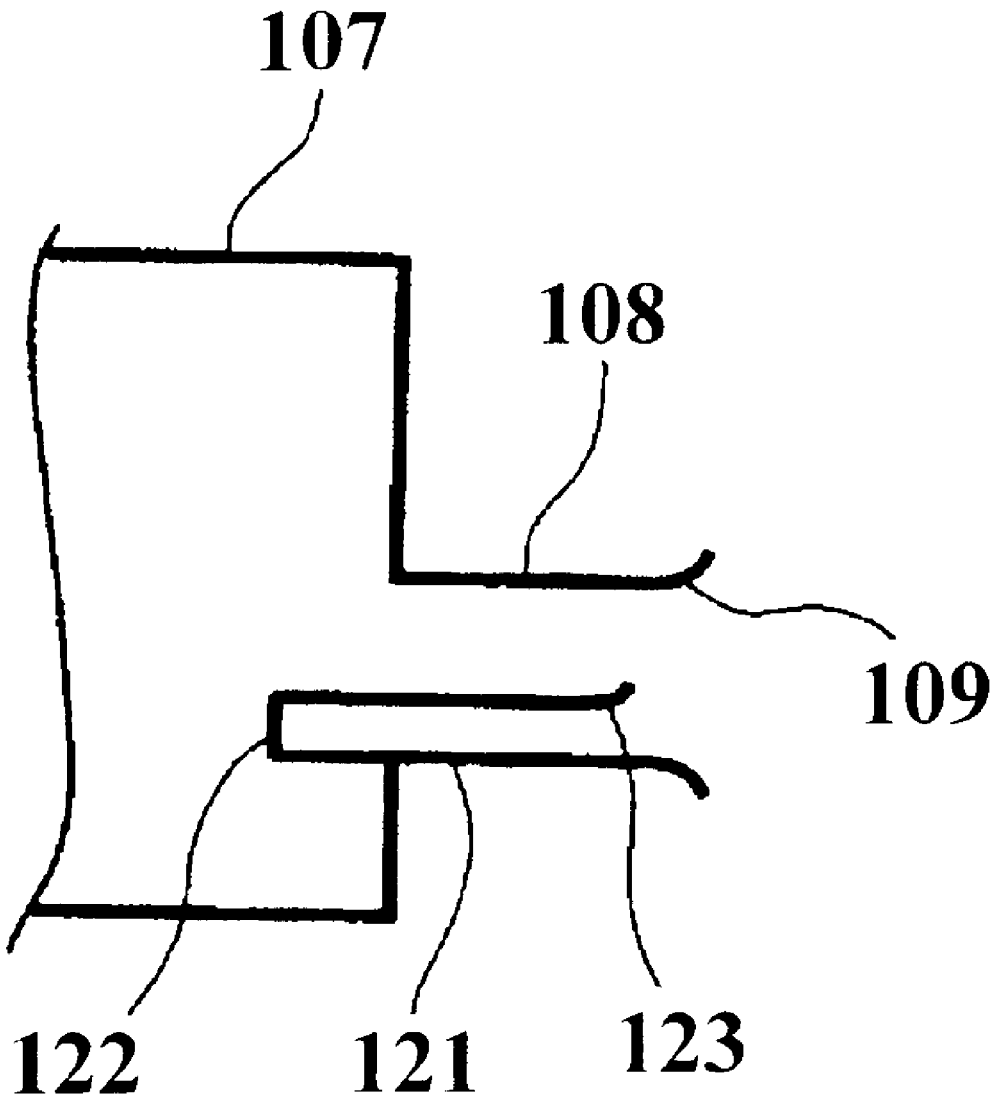
FIG. 9 is a partial schematic view, in part similar to FIG. 8, and shows an eighth embodiment of the invention.

FIG. 9 shows another embodiment of the invention which is generally similar to the embodiment of FIG. 8 and thus, this is shown in only a partial figure. In this embodiment, components which are the same as those previously described have been identified by the same reference numerals.

The side branch tube, 121 in this embodiment, extends into the interior of the main muffler 101 and has a closed end wall 122 positioned therein. Its atmospheric facing opening 123 faces the atmospheric opening 109 of the outlet tube 108 and thus functions in the manner as thus previously described.

Figure 10:
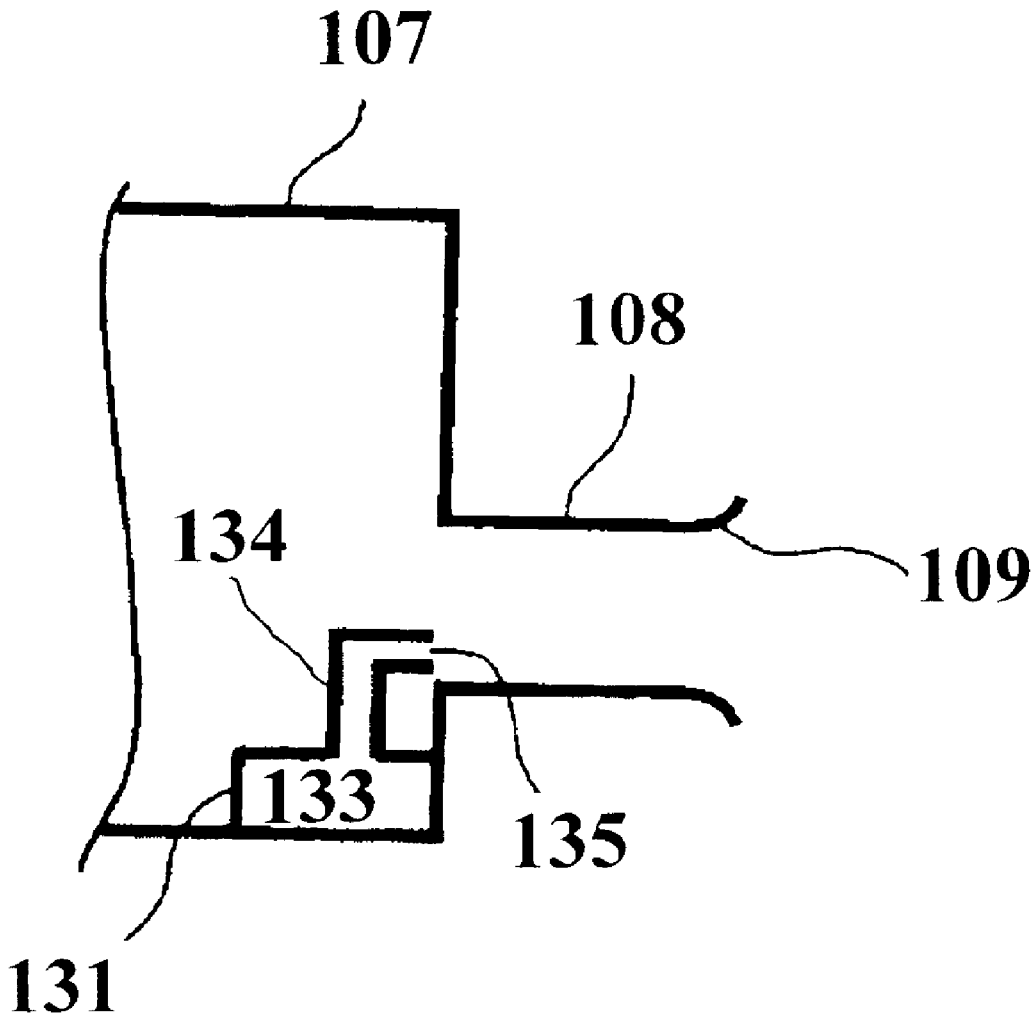
FIG. 10 is a partial schematic cross-sectional view, in part similar to FIG. 9, and shows a tenth embodiment of the invention.

FIG. 10 shows another embodiment of the invention which is generally similar to FIGS. 8 and 9 but which embodies a Helmholtz resonator 131 which is positioned within the rear portion of the main muffler 107. The Helmholtz resonator 131 has a chamber 132 which communicates with the atmosphere through a tube section 134. The tube section 134 has, in this embodiment, an L shape so that its atmospheric opening 135 will face the atmospheric opening 109 of the exhaust outlet tube 108.

Figure 11:
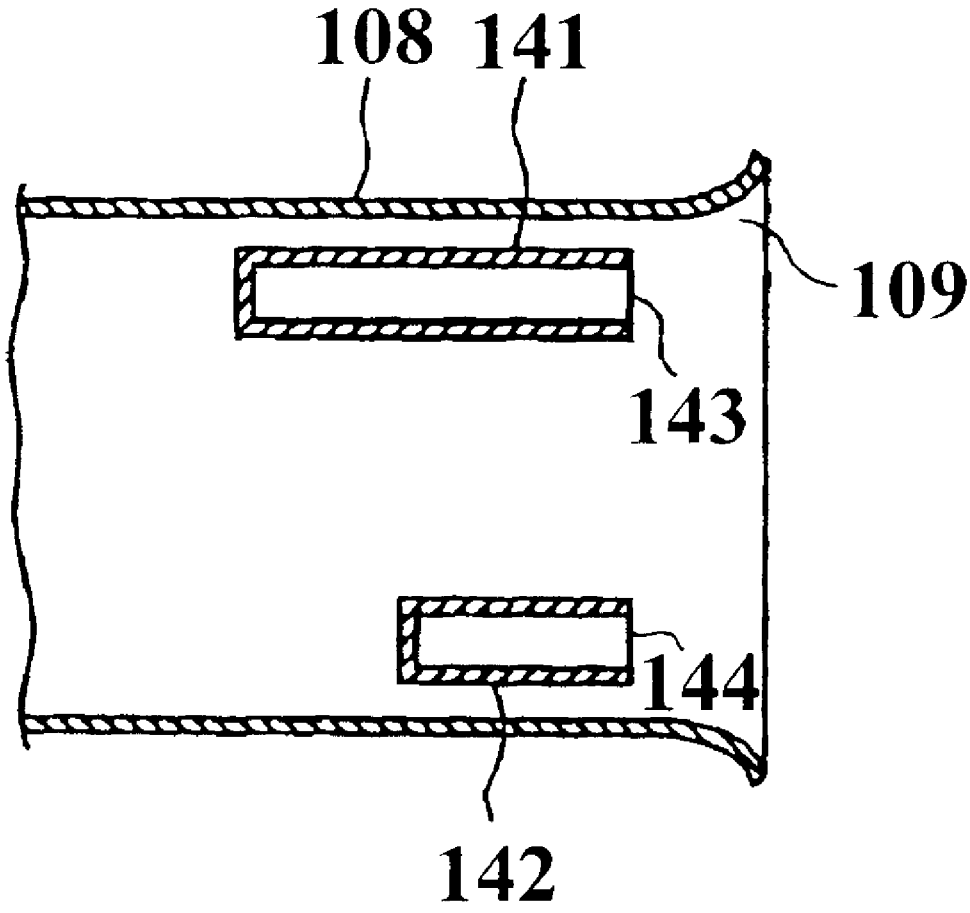
FIG. 11 is a partial schematic cross-sectional view, in part similar to FIGS. 9 and 10, and shows an eleventh embodiment of the invention.

FIG. 11 shows a further arrangement for positioning in the outlet tube 108 of the main muffler which is not shown in this figure, but which has its outlet opening 109 as afore described. In this embodiment, there are provided a pair of side branch tubes 141 and 142 each of which has a closed end adjacent the muffler 107 and a respective atmospheric opening 143 and 144 facing the exhaust outlet pipe atmospheric opening 109.

It should be understood that the afore described arrangements for varying the length of the side branch tubes and either the tube or volume of the Helmholtz resonator as previously described may be employed in the exhaust side of the system.

Figure 12:
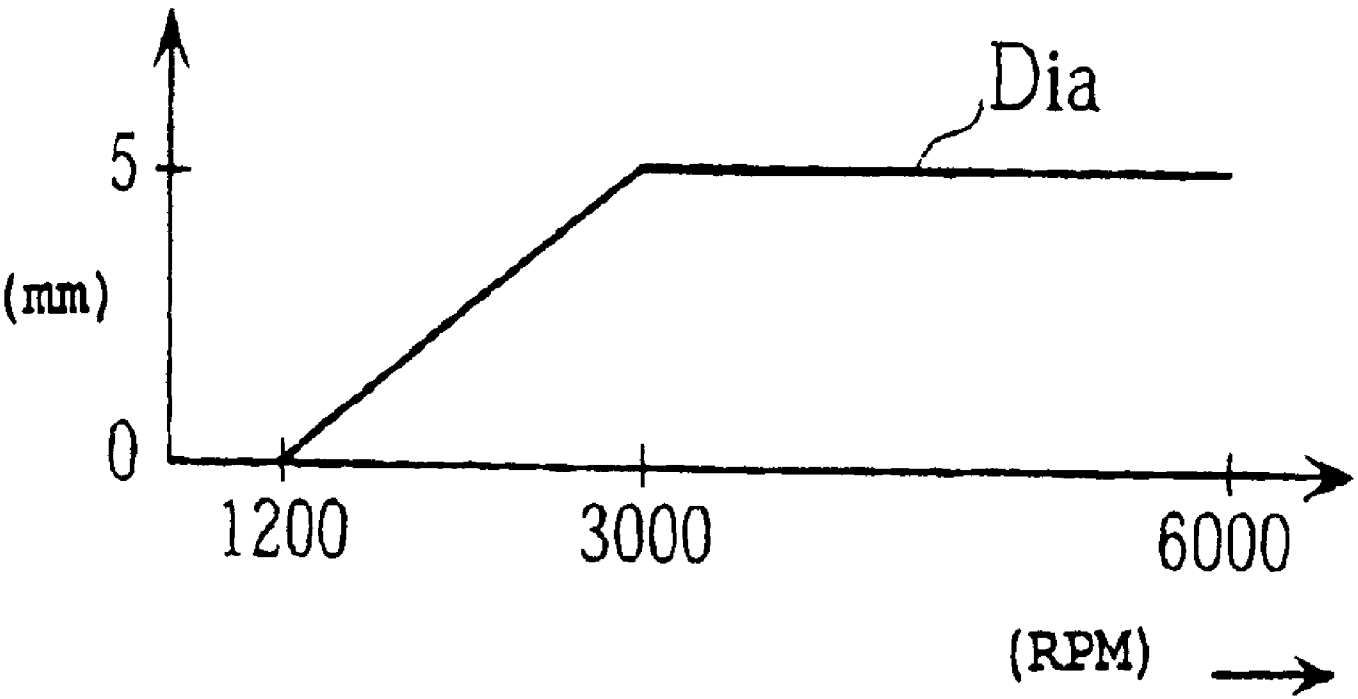
FIGS. 12 and 13 are graphical views showing how the system shown in FIG. 11 could be modified to change respectively the diameter of the orifices in the opening and the length thereof in response to changes in engine speed to improve the performance.

If desired, the diameter of inlet opening of the branch tube can be adjusted so as to change the sound effect and this can be done in the embodiment of FIG. 11 as shown in FIG. 12 wherein the diameter of the tubes 143 and 144 are changed in response to engine speed changes.

Figure 13:
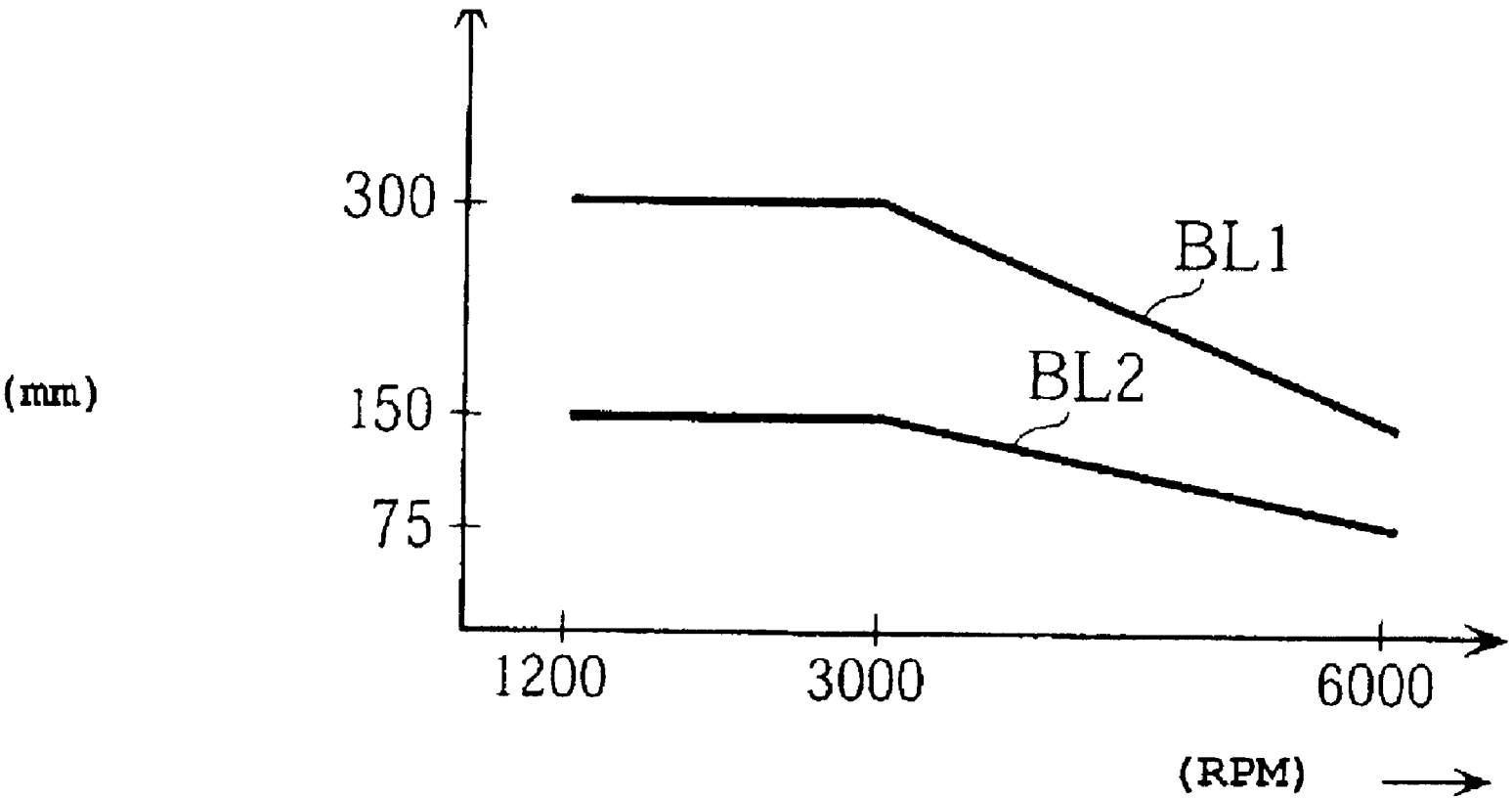
Figure 14:
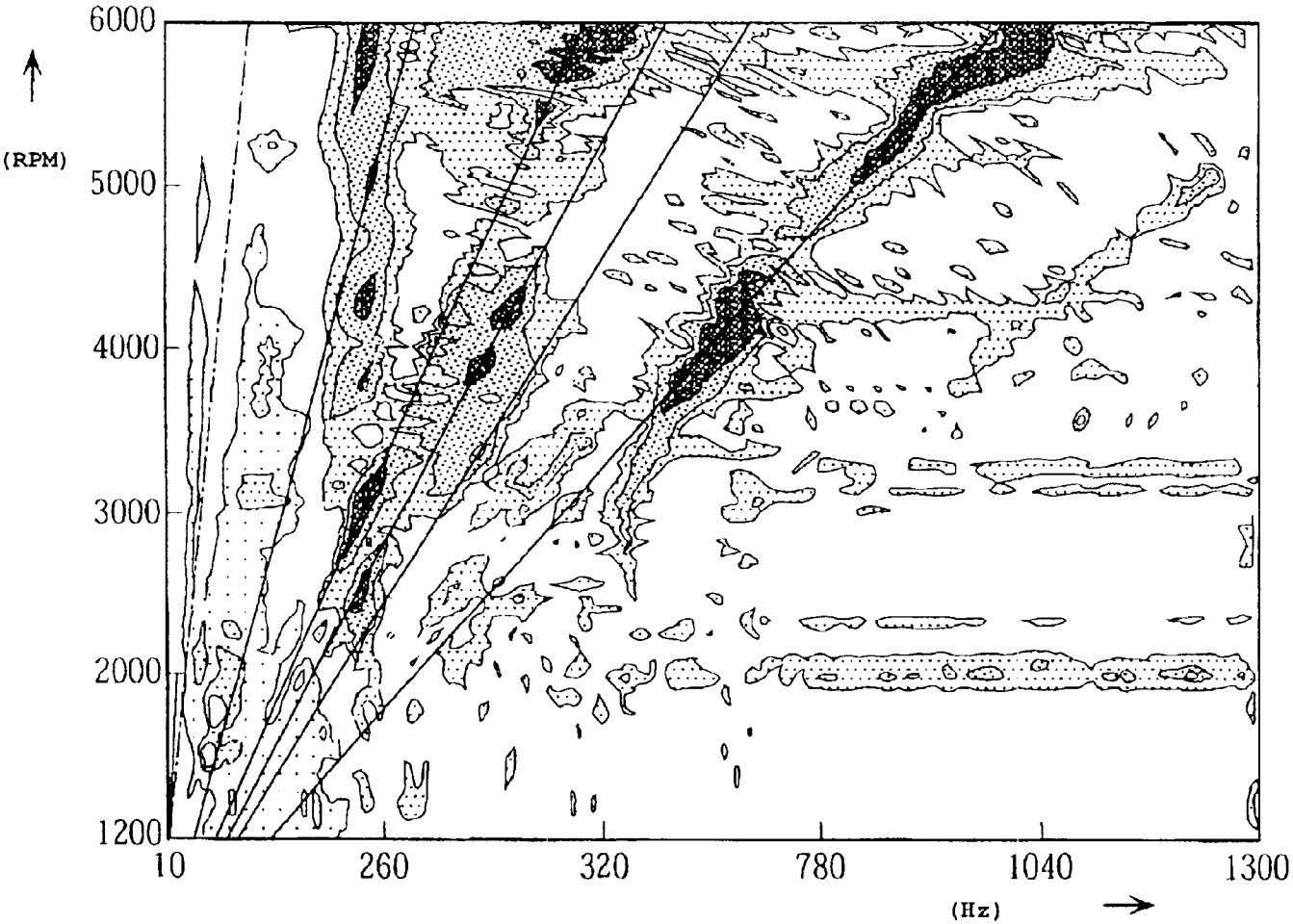
FIGS. 14 and 15 show how the sound waves in the system in accordance with the invention compare with those in the prior art.
Figure 15:
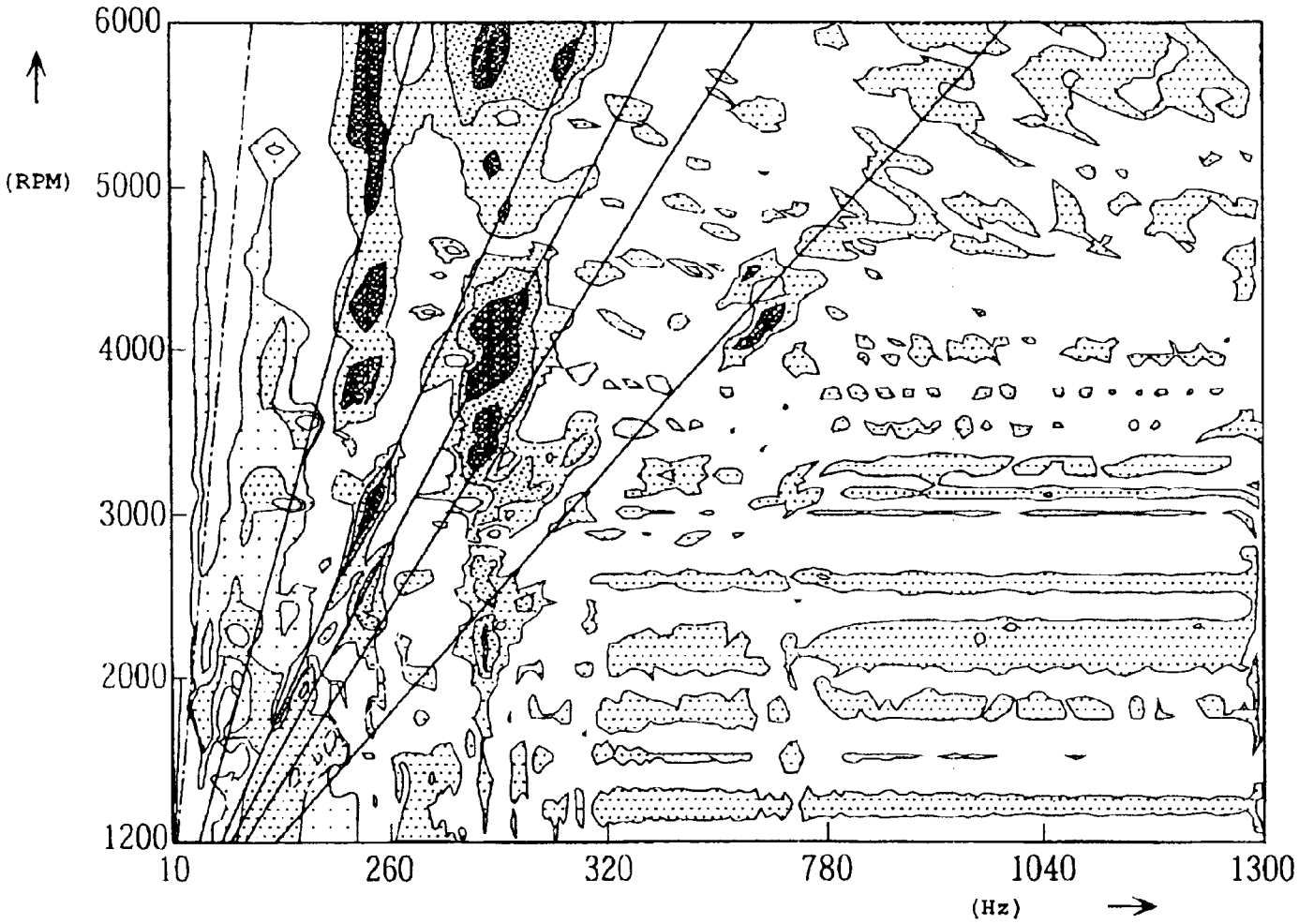

In addition, the lengths can be changed as shown in FIG. 13 also in response to changes in speed to obtain the desired effect. The effect of this type of arrangement relative to the prior art can be understood by a comparison of FIG. 14, which shows the invention, with FIG. 15, which shows the prior art type of arrangement. It is desired in this specific embodiment to obtain amplification in the range of about 260 Hz. As may be seen in FIG. 14 as compared with FIG. 15, the sound in this range is maintained fairly constant at all engine speeds while in the prior art type of construction, there is little concentration of the sound at this particular range except at extremely high engine speed. Of course, this can be done to improve the sound at other frequencies than those in the range of about 260 Hz.

Figure 16:
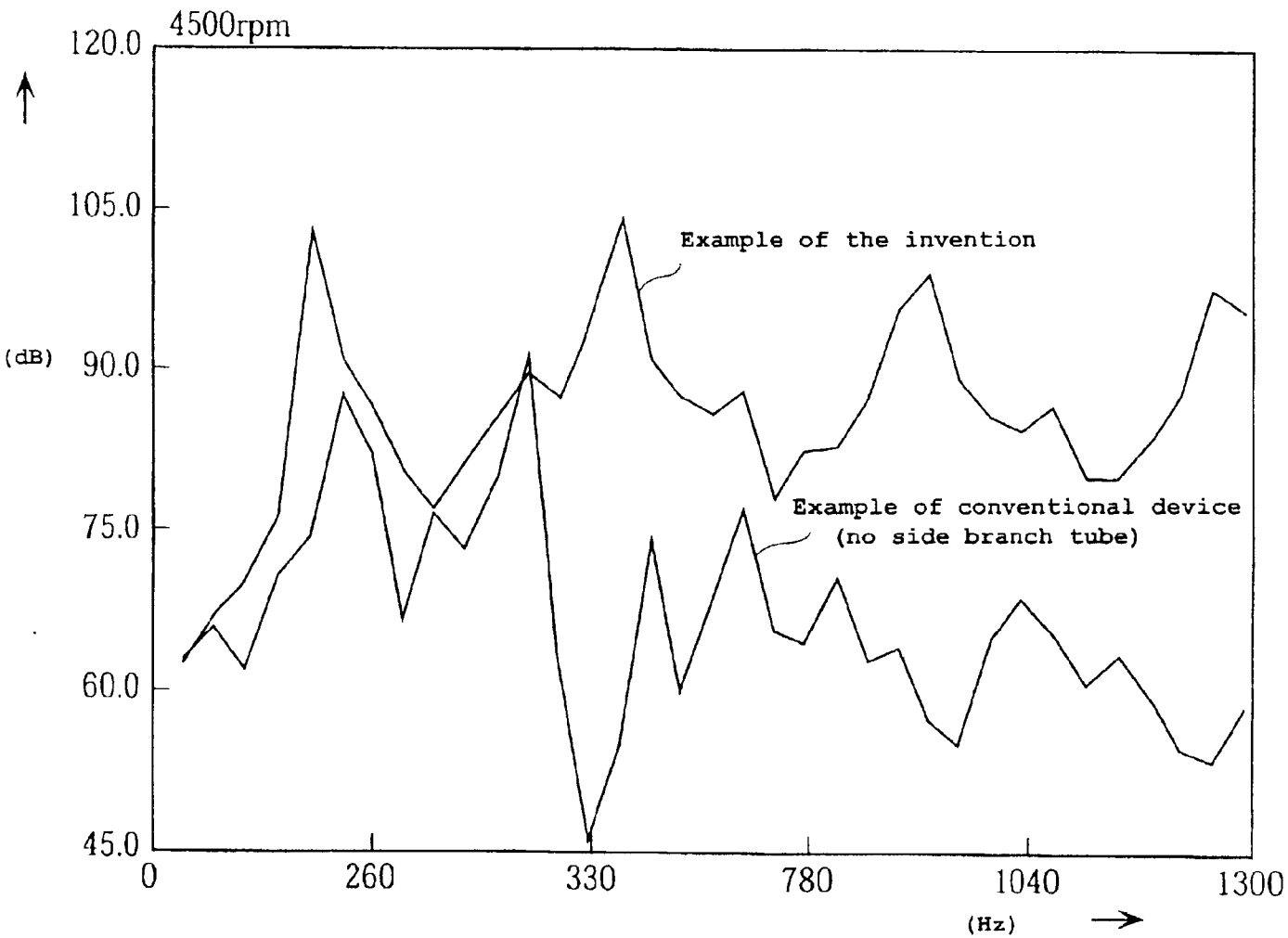
FIG. 16 is a graphical view also showing a comparison of the sound waves and frequencies in connection with the prior art and the invention.

FIG. 16 shows how the inventive arrangement as shown in the curve A can provide significant increases in various speed ranges over the conventional system as indicated by the curve B. Again, the peaks occur at the desired frequencies and are considerably higher than those in the prior art.

Therefore, in accordance with the described embodiments it is possible to obtain the desired sounds in either or both of the intake and exhaust systems by amplifying the desired frequencies, rather than by attempting to dampen all of the other or undesired frequencies. This provides a significant simplification and permits the obtainment of a result over a wider range of engine operating conditions. Of course, the foregoing description is that of preferred embodiments of the invention and various changes and modifications may be made without departing from the spirit and scope of the invention, as defined by the appended claims.

What is claimed is:

1. An internal combustion engine comprised of an engine body forming at least one combustion chamber, an induction system having an atmospheric communication opening for introducing at least an air charge to said combustion chamber, an exhaust system for discharging exhaust gasses from said combustion chamber through an atmospheric communicating opening, and an acoustical device having an opening facing the atmospheric communicating opening of the system, said acoustical device amplifying sounds of a predetermined specific frequency and delivering the amplified sounds to the atmosphere.

2. An internal combustion engine as set forth in claim 1, wherein the effect of the acoustical device is variable.

3. An internal combustion engine as set forth in claim 2, wherein the effect of the acoustical device is varied by changing a physical characteristic thereof.

4. An internal combustion engine as set forth in claim 3, wherein the physical characteristic effect the acoustical device is varied by changing the extent of its opening.

5. An internal combustion engine as set forth in claim 3, wherein the physical characteristic effect the acoustical device is varied by changing its length.

6. An internal combustion engine as set forth in claim 3, wherein the physical characteristic effect the acoustical device is varied by changing its volume.

7. An internal combustion engine as set forth in claim 1, wherein the acoustical device comprises a side branch resonator.

8. An internal combustion engine as set forth in claim 7, wherein the effect of the acoustical device is variable.

9. An internal combustion engine as set forth in claim 8, wherein the effect of the acoustical device is varied by changing a physical characteristic thereof.

10. An internal combustion engine as set forth in claim 9, wherein the physical characteristic effect the acoustical device is varied by changing the extent of its opening.

11. An internal combustion engine as set forth in claim 10, wherein the physical characteristic effect the acoustical device is varied by changing its length.

12. An internal combustion engine as set forth in claim 1, wherein the opening of the acoustical device is contiguous to the atmospheric communicating opening of the system with which it is associated.

13. An internal combustion engine as set forth in claim 1, wherein the acoustical device is positioned within the induction system and amplifies a predetermined sound frequency therein.

14. An internal combustion engine as set forth in claim 1, wherein the acoustical device is associated with the exhaust system.

15. An internal combustion engine as set forth in claim 1, wherein an acoustical device is associated with each of the induction system and the exhaust system.

16. An internal combustion engine as set forth in claim 1, wherein the engine has at least two groups of combustion chambers and at least the system containing the acoustical device has separate branches serving each group from a common atmospheric communicating opening with which said acoustical device cooperates and faces.

17. An internal combustion engine comprised of an engine body forming at least one combustion chamber, an induction system having an atmospheric communication opening for introducing at least an air charge to said combustion chamber, an exhaust system for discharging exhaust gasses from said combustion chamber through an atmospheric communicating opening, and an acoustical device for amplifying sounds of a predetermined frequency in at least one of said induction and exhaust systems having an opening facing the atmospheric communicating opening of the system and comprising a Helmholtz resonator comprised of a chamber communicating with its opening through a tube.

18. An internal combustion engine as set forth in claim 17, wherein the effect of the Helmholtz resonator is variable.

19. An internal combustion engine as set forth in claim 18, wherein the effect of the Helmholtz resonator is varied by changing a physical characteristic thereof.

20. An internal combustion engine as set forth in claim 19, wherein the physical characteristic effect the Helmholtz resonator is varied by changing the volume of its chamber.

21. An internal combustion engine as set forth in claim 19, wherein the physical characteristic effect the Helmholtz resonator is varied by changing the length of the tube.

* * * * *